US007717040B2

(12) United States Patent
Shishkin

(10) Patent No.: US 7,717,040 B2
(45) Date of Patent: May 18, 2010

(54) PLATE CUTTING AND IMAGING WITH SAME DEVICE

(75) Inventor: Igor Shishkin, Rishon le Zion (IL)

(73) Assignee: Eastman Kodak Company, Rochester, NY (US)

( * ) Notice: Subject to any disclaimer, the term of this patent is extended or adjusted under 35 U.S.C. 154(b) by 407 days.

(21) Appl. No.: 11/758,152

(22) Filed: Jun. 5, 2007

(65) Prior Publication Data

US 2008/0305436 A1 Dec. 11, 2008

(51) Int. Cl.
*B41M 5/00* (2006.01)

(52) U.S. Cl. ..... 101/463.1; 101/401.1; 430/302

(58) Field of Classification Search ..... 101/463.1
See application file for complete search history.

(56) References Cited

U.S. PATENT DOCUMENTS 5,205,039 A * 4/1993 Ternes ..... 29/895.21
5,826,513 A * 10/1998 Fromson et al. ..... 101/463.1
5,846,691 A * 12/1998 Cusdin et al. ..... 430/300
6,112,664 A * 9/2000 Naniwa et al. ..... 101/463.1
6,161,479 A * 12/2000 Murray ..... 101/453
7,171,901 B2 * 2/2007 Salvestro ..... 101/401.1
2003/0152868 A1 * 8/2003 Hiraoka ..... 430/303
2004/0129157 A1 * 7/2004 Dewitte ..... 101/382.1

* cited by examiner

*Primary Examiner*—Jill E Culler
(74) *Attorney, Agent, or Firm*—Nelson Adrian Blish

(57) ABSTRACT

A method for cutting flexographic plates (10) while plate imaging process is performed is described. The method includes mounting a flexographic plate (10) on an imaging drum (30); imaging at least one graphical element or piece (11) on the flexographic plate; cutting the graphical piece using the imaging device (31); and removing at least one graphical piece from the imaging device drum.

17 Claims, 3 Drawing Sheets

PLATE CUTTING AND IMAGING WITH SAME DEVICE

CROSS REFERENCE TO RELATED APPLICATIONS

Reference is made to commonly-assigned co-pending U.S. patent application Ser. No. 11/615,025, filed Dec. 22, 2006, entitled HYBRID OPTICAL HEAD FOR DIRECT ENGRAVING OF FLEXOGRAPHIC PRINTING PLATES, by Alon Siman Tov et al., the disclosure of which is incorporated herein.

FIELD OF THE INVENTION

This invention relates in general to precision cutting of a flexographic plate while positioned on a flexographic imaging device, and in particular to utilizing the flexographic imaging device and high power laser diodes for cutting.

BACKGROUND OF THE INVENTION

The flexographic plate, using current technologies is imaged (or engraved) using a specially designed flexographic imaging device. Flexographic plates are relatively expensive, therefore flexographic plates will usually accommodate more than one distinct graphical art piece. For example, if a packaging job of a consumer product is requested, the job will usually include several different graphic art pieces, such as the front, back and sides of the package. The imaging of the flexographic plate, will include in this case the imaging of all those graphic art pieces in one imaging step. At this point the imaged flexographic plate comprises several distinct graphic art pieces. Those graphic art pieces are usually cut before they are positioned on a printing press.

In current printing technologies, the plate cutting is performed as a post imaging step. Often cutting is done manually on a manual cutting table, using a cutting blade. There are also automatic cutting machines, which receive the cutting geometry for a specific plate from a dedicated workstation. The supplied cutting geometry is translated to machine cutting commands for implementing the actual plate cutting. Cutting the flexographic as an extra step, in addition to the flexographic imaging machine process, is time consuming and costly, and manual cutting may result in lack of precision.

SUMMARY OF THE INVENTION

Briefly, according to one aspect of the present invention a method for cutting flexographic plates while plate imaging process is performed, comprises the steps of: mounting a flexographic plate on an imaging drum; imaging at least one graphical piece on the flexographic plate; cutting the graphical piece using the imaging device; and removing at least one graphical piece from the imaging device drum.

According to one embodiment of the present invention the precise cutting that is proposed by this invention, is based on utilization of the flexographic output device imaging means. At the point that the flexographic plate is fully exposed by the imaging device, the imaged plate is still mounted on the imaging device drum. At this stage, the lasers of the output device are deployed to cut around or mark the cutting of the various graphic art pieces by laser engraving around the proposed cutting piece. This process will yield a very precise cutting of the individual pieces, and will almost finalize the cutting process, before unmounting the flexographic plate from the imaging output device.

These and other objects, features, and advantages of the present invention will become apparent to those skilled in the art upon a reading of the following detailed description when taken in conjunction with the drawings wherein there is shown and described an illustrative embodiment of the invention.

DETAILED DESCRIPTION OF THE INVENTION

The present description is directed in particular to elements forming part of, or cooperating more directly with, apparatus in accordance with the invention. It is to be understood that elements not specifically shown or described may take various forms well known to those skilled in the art.

In flexographical printing, it is common to image more than one graphical element on a single flexographic printing plate. The graphical elements, which will eventually be separated into more then one flexographical plate piece, may be independently printed on a printing machine at more then one printing session. The main reason for ganging the imaging of the plurality of graphical elements in one imaging session, lies in the high cost of the flexographical plates.

The present invention describes methods and apparatus for cutting graphical elements of flexographic plates, during the flexographical plates imaging process. This invention eliminates the need to perform an additional step in flexographical pre press workflow to cut the plate into more than one piece. The plate cutting step is performed today at the stage when the plate is un mounted from the imaging device. The plate cutting today can be done by:

1. A manual process using a special cutting table using precision tools and cutting blades.
2. Applying a post imaging cutting machine, such a machine is produced by Misomex International of Nashua, N.H. Misomex offers a range of flatbed x-y plotting machines with cutting heads.

Figure 1:
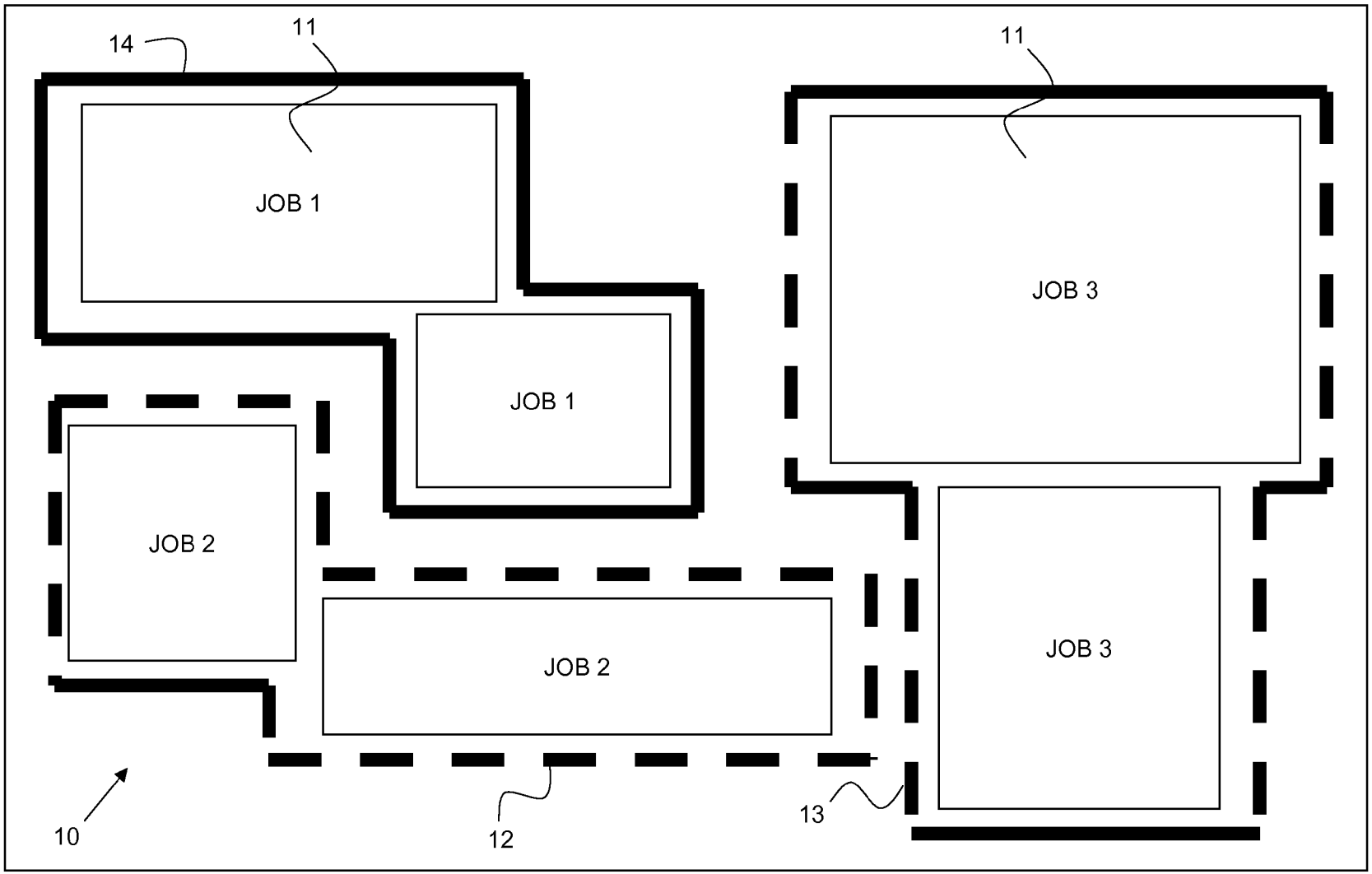
FIG. 1 is a schematic of a flexographic printing plate, illustrating the cutting areas around various graphic art pieces positioned on the flexographic printing plate.

FIG. 1 illustrates an example of an imaged flexographic plate, with cutting areas according to the present invention. The printing plate 10 shows three different flexographic graphical elements 11, each element belongs to a distinct printing job. Each graphical element or printing job, is separated by cut areas 12. The cutting process of the areas 12, in the present invention, is performed at the imaging stage of the flexographic plate.

Figure 3:
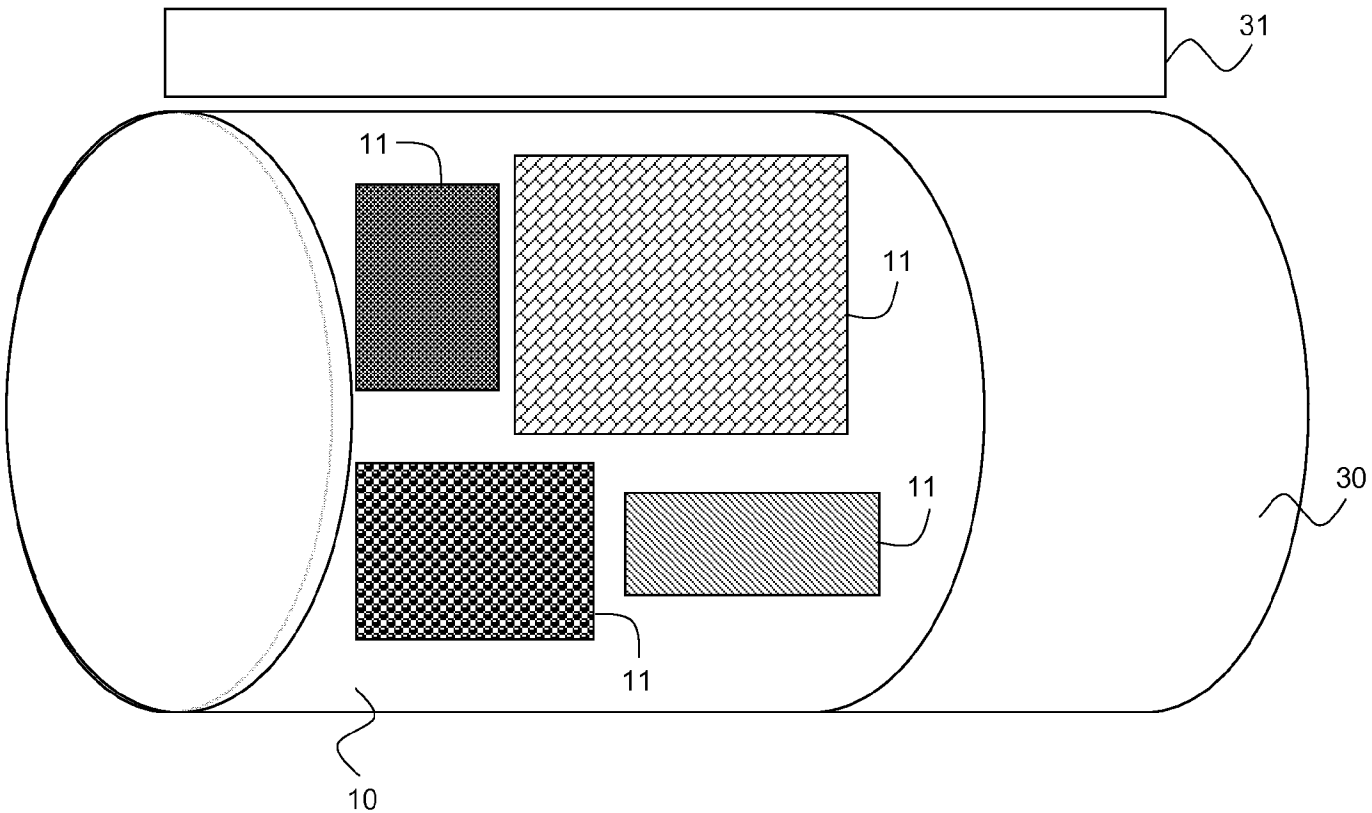
FIG. 3 is schematic of printhead and an imaging drum, with a flexographic printing plate mounted on the drum.

The same laser engraving means used for imaging the plate, are utilized to produce the cutting areas 12, 13, or 14 while the flexographic printing plate 10 is mounted on the imaging drum 30 as is depicted in FIG. 3. FIG. 3 shows printhead 31, which is used for imaging of the graphical elements 11 on the flexographic printing plate 10. Printhead 31 is used for cutting the graphical elements 11, as well, while printing plate 10 is mounted on the imaging drum 30.

Referring again to FIG. 1, plate cutting can be performed in various manners; for example, full cutting as is illustrated in cutting area 14 or partial cutting as is illustrated in 13. Cutting area 13 illustrates full cutting in the x-axis and partial cutting in the y-axis. The reason for using those various cutting styles depends on the available means for attaching the plate to the imaging device drum. Whenever the attaching means are such that a fully cut piece of plate is firmly attached, for example, plates are held on the drum by a strong vacuum, a full cut can be used. Otherwise partial cut such as illustrated by cutting area 12 or 13 should be used.

Figure 2:
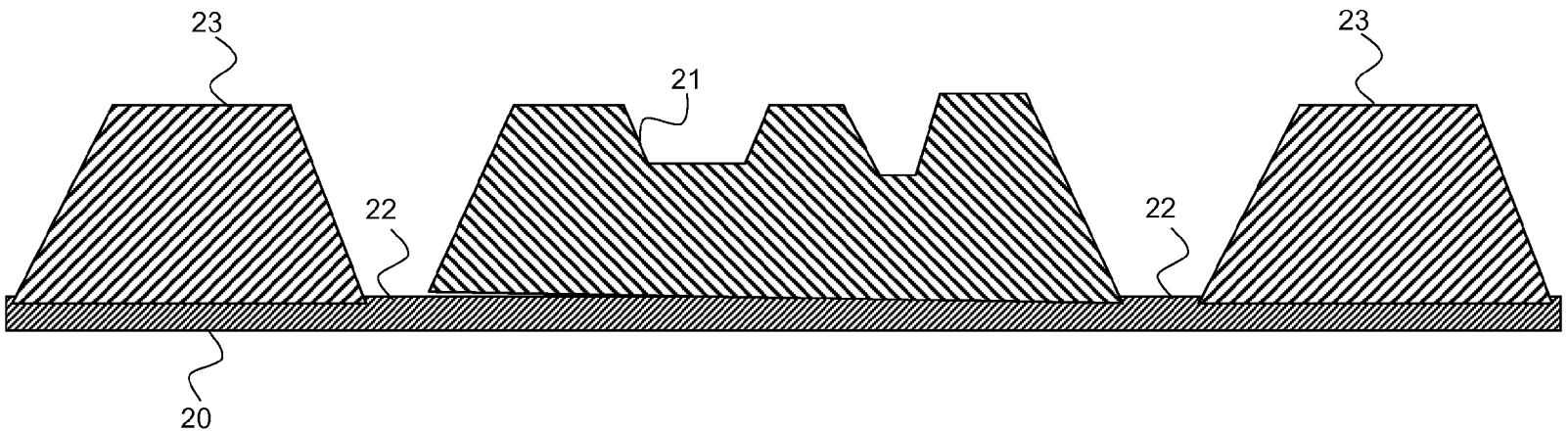
FIG. 2 is a sectional schematic view of a flexographic a printing plate, illustrating an area where the plate cutting is performed, elevated ink transfer areas, and blank areas.

FIG. 2 illustrates a sectional view of flexographic printing plate 10. It shows an imaged area 21, which belongs to an imaged graphical element. On both sides of imaged area 21, there are additional imaged areas 23, each belong to a different graphical element. The imaged areas 21 and 23, are separated by a cutting area 22. The cutting areas shows that the flexographic plates is engraved as deep as the entire thickness of the printing plate, reaching up to the level of the imaging device drum 20.

The cutting areas 22 can be made by the imaging device in the same imaging step at the same time as the imaging of the graphical elements. The plate cutting can be also performed as a separate step, while the plate is still mounted on the imaging device by utilizing a high power coarse laser as is disclosed in commonly-assigned copending U.S. patent application Ser. No. 11/615,025, or by multiple passes with a lower power laser. Parts of the cutting areas 22 maybe partially cut, as was discussed above. The reason for applying a partial cut is, for firmly attaching the plate pieces to the imaging device drum, to avoid plate staggering or plate pieces leaving the drum.

When imaging of more than one graphical element is completed, and there is a need to remove it from the imaging device for further processing; the imaging device is stopped, and the required graphical elements are unmounted from the imaging device drum. This is performed by completing a manual cutting of the thin areas which were originally left uncut. As mentioned above, the partial cut is used when there are no alternative means available for firmly attaching the graphical elements to the imaging device drum. In the case of partial imaging of the flexographic plate, the further imaging of at least one graphical element can be performed by applying an additional imaging pass.

It another embodiment of the invention, the flexographic plate is imaged in a first step in. In a second step, the rotation of the drum 30 is slowed and the cutting step in is performed. Slowing the rotation of the drum during the cutting step, reduces the possibility of one of the cut, graphical elements leaving the surface of the drum due to centrifugal forces.

The invention has been described in detail with particular reference to certain preferred embodiments thereof, but it will be understood that variations and modifications can be effected within the scope of the invention.

PARTS LIST

10 flexographic printing plate
11 imaged graphical element or piece
12 fully cut area
13 partially cut area
14 cutting area at which one axis is fully cut, and the other is partially cut
20 level of the imaging device drum
21 cut around imaged area (elevated ink transfer areas and blank areas are shown)
22 cutting areas
23 separated imaged areas
30 imaging drum
31 printhead

The invention claimed is:

1. A method for cutting flexographic plates while plate imaging process is performed, comprising the steps of:
mounting a flexographic plate on an imaging drum;
imaging at least one graphical piece on said flexographic plate;
cutting said graphical piece using the imaging device; and
removing said at least one graphical piece from said imaging device drum.

2. The method of claim 1, wherein the plate imaging and graphical piece cutting in performed in a single imaging step.

3. The method of claim 1, wherein the plate is imaging is performed in first step, and graphical piece cutting is performed in an additional step.

4. The method of claim 1, wherein cutting the graphical piece is performed in full.

5. The method of claim 1, wherein cutting the graphical piece is performed partially.

6. The method of claim 1, wherein cutting the graphical piece is partially performed in first axis, and a full cut in second axis.

7. The method of claim 1, wherein at least one graphical piece is removed from the imaging device drum, and imaging continued in an additional steps.

8. The method of claim 1, wherein the imaging step is performed at a first speed at the cutting step is performed at a second speed.

9. An apparatus for imaging and cutting a flexographic plate comprising:
a drum for mounting the flexographic plate; and
a printhead for imaging the flexographic plate and for cutting graphical elements from the flexographic plate.

10. The apparatus of claim 9 wherein the imaging and cutting of the flexographic plate take place in a single step.

11. The apparatus of claim 9 wherein the imaging of the flexographic plate takes place in a first step and the cutting of the graphical elements takes place in a second step.

12. The apparatus of claim 9 wherein at least one of the graphical elements is partially cut from the plate.

13. The apparatus of claim 9 wherein at least one of the graphical elements is fully cut from the plate.

14. The apparatus of claim 9 wherein at least one of the graphical elements is fully cut in only one horizontal or vertical direction.

15. The apparatus of claim 9 wherein at least one graphical element is imaged, fully cut from the plate, and removed from the plate prior to imaging other graphical elements.

16. The apparatus of claim 9 wherein the drum is rotated at a first speed during imaging and rotated in a second speed during cutting.

17. The apparatus of claim 9 wherein the flexographic plate is held on a surface of the drum by a vacuum.

* * * * *